US005228499A

United States Patent [19]

Yoon

[11] Patent Number: 5,228,499

[45] Date of Patent: Jul. 20, 1993

[54] REFRIGERATOR INCLUDING A FERMENTATION AND ENSILAGE COMPARTMENT, AND THE CONTROL METHOD THEREOF

[75] Inventor: Kwang H. Yoon, Suweon, Rep. of Korea

[73] Assignee: SamSung Electronics Co., Ltd., Suwon, Rep. of Korea

[21] Appl. No.: 771,565

[22] Filed: Oct. 8, 1991

[30] Foreign Application Priority Data

Oct. 15, 1990 [KR] Rep. of Korea ..... 90-16389

[51] Int. Cl.[5] ..... F25B 29/00

[52] U.S. Cl. ..... 165/2; 165/30

[58] Field of Search ..... 165/2, 30, 48.1, 63

[56] References Cited

U.S. PATENT DOCUMENTS

| | | | |
|---|---|---|---|
| 2,579,848 | 12/1951 | Nave | 165/30 |
| 3,590,911 | 7/1971 | Horvay | 165/30 |
| 3,638,717 | 2/1972 | Harbour et al. | 165/30 |
| 4,913,223 | 4/1990 | Mizuno | 165/63 X |

*Primary Examiner*—Stephen M. Hepperle

*Attorney, Agent, or Firm*—Robert E. Bushnell

[57] ABSTRACT

The refrigerator having a fermentation function includes a fermentation and ensilage compartment independent from a freezing compartment and a refrigerating compartment. A heating apparatus, a delivery duct, a return duct, dampers opening and closing the ducts, and temperature sensor are mounted in the fermentation and ensilage compartment. The temperature of fermentation and ensilage compartment is detected by the temperature sensor and the heating apparatus and the dampers are controlled according to the detected temperature.

18 Claims, 4 Drawing Sheets

REFRIGERATOR INCLUDING A FERMENTATION AND ENSILAGE COMPARTMENT, AND THE CONTROL METHOD THEREOF

FIELD OF THE INVENTION

This invention relates to a refrigerator and a control method thereof and more particularly to a refrigerator having a fermentation and ensilage compartment which is independent of a refrigerating compartment and a freezing compartment and a method for independently controlling the temperature of each compartment.

BACKGROUND OF THE INVENTION

Conventional refrigerators do not include a fermentation compartment, but rather include only a refrigerating compartment and a freezing compartment. There exist, however, fermentation refrigerators which include only a fermentation compartment.

A fermentation refrigerator performs a normal storage function by lowering the temperature in the same manner as a conventional refrigerator. However, in performing the fermentation function, because the fermentation refrigerator raises the temperature to the fermentation temperature, it has a disadvantage in that foods stored within it must be taken out and moved into a conventional refrigerator, which provides a low temperature so that the foods do not deteriorate or spoil.

When the fermentation function is desired, a conventional refrigerator cannot raise the temperature therein to the fermentation temperature, so it has the disadvantage of requiring one in need of such function to purchase a conventional refrigerator and a fermentation refrigerator, and to provide the space to house both units.

A typical example of the prior art is disclosed in Japanese Patent Publication Sho 56-168069. This patent relates to a refrigerator comprising a freezing compartment including a first freezer, a refrigerating compartment including a second freezer and a sub-compartment including a third freezer convertible to a freezing compartment or to a refrigerating compartment. A first path switchover device controls a portion of the refrigerant to the second freezer and a second path switchover device controls a portion of the refrigerant to the third freezer. The refrigerant path switchover is controlled by the first and the second refrigerant path switchover devices whereby one of the states supplies refrigerant to the first and the second freezer, another state supplies refrigerant to the first and the third freezer, and another state supplies refrigerant to only the first freezer, a decision is formed based on detection of the inner temperature of refrigerator.

The embodiment disclosed in the Sho 56-168069 patent includes a freezing compartment, a refrigerating compartment and a sub-compartment and controls the temperature of each compartment. However, the sub-compartment is convertible to a freezing compartment or to a refrigerating compartment and thus it does not have a fermentation function. Accordingly, it does not solve the above mentioned problems.

SUMMARY OF THE INVENTION

The present invention is devised to solve the above problems related to providing a multiple function device which includes a freezing, refrigerating and fermentation capability in a single unit.

It is the object of the present invention to supply a refrigerator including, for separate use, a fermentation and ensilage compartment performing fermentation and ensilage functions.

It is another object of the present invention to supply a refrigerator and a control method thereof to include a fermentation and ensilage compartment in which a heating apparatus is mounted whereby the temperature therein can be raised to the fermentation temperature.

It is another object of the present invention to supply a refrigerator and a control method thereof to include a fermentation and ensilage compartment in which a delivery duct and a return duct, and mounted dampers opening and shutting the ducts, thereby enable storage of fermentation food by circulating chilled air to a fermentation and ensilage compartment.

According to the present invention, the apparatus comprises a fermentation and ensilage compartment independent from a freezing compartment and a refrigerating compartment. A heater duct assembly mounted in the fermentation and ensilage compartment and including a heater, a blowing fan and a related duct, are utilized. A delivery duct introduces chilled air from an evaporator into the fermentation and ensilage compartment. A damper mounted to open/close the delivery duct, a return duct for circulating the compartment air from the fermentation and ensilage compartment to the evaporator and a damper mounted to open/close the return duct are also utilized in the present invention.

According to the principles of the present invention, a method for controlling the apparatus comprises the steps of:

detecting/holding the freezing compartment temperature to a freezing reference temperature, holding the fermentation and ensilage compartment at the fermentation temperature in response to the selection of the fermentation mode after controlling the freezing compartment and then automatically converting the fermentation mode into the ensilage mode at the finishing step, and holding the temperature of the fermentation and ensilage compartment at the ensilage temperature in response to the selection of the ensilage mode after controlling the freezing compartment, and holding the temperature of the refrigerating compartment at the refrigerating reference temperature.

DETAILED DESCRIPTION OF THE INVENTION

The preferred embodiment of the invention is described with reference to the drawings.

Figure 1:
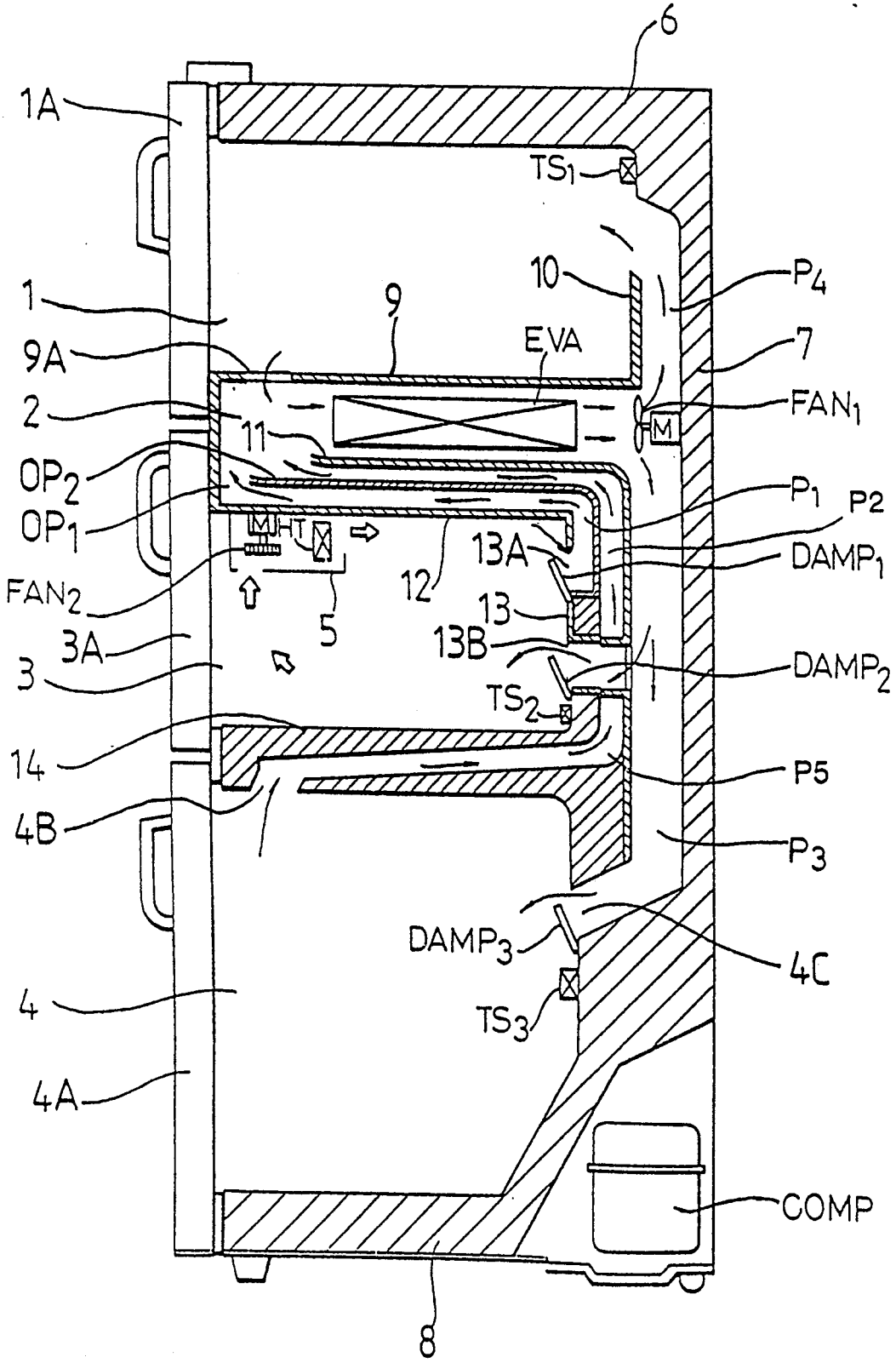
FIG. 1 is a cross-sectional side view of the refrigerator according to the present invention.

FIG. 1 is a cross-sectional side view showing the structure of the refrigerator according to the present invention. The refrigerator according to the present invention includes a freezing compartment 1 in the upper portion, a fermentation and ensilage compartment 3 in the middle portion and a refrigerating compartment 4 in the lower position. A cooling compartment 2 is positioned between the freezing compartment 1 and the fermentation and ensilage compartment 3.

The top 6, the rear panel 10, the bottom 9 the side walls (not shown) and the door 1A form the freezing compartment 1. The rear panel 10 extends from the bottom 9 of freezing compartment is spaced apart from the rear wall 7, and is formed at a predetermined space, whereby the space between the rear panel 10 and the rear wall 7 forms a duct P4 for delivering chilled air to the freezing compartment. Frozen food is positioned on the bottom 9. An opening 9A is formed at a position spaced apart from the front edge of the bottom 9, whereby the freezing compartment 1 opens into the cooling compartment 2. Thus, the air of the freezing compartment 1 is delivered to the cooling compartment 2 through the opening 9A formed in the bottom 9. After the delivered air becomes cool through evaporator EVA, it is discharged to the freezing compartment 1 through the duct P4 formed between the rear panel 10 and the rear wall 7.

The cooling compartment 2 is formed in the partition between the freezing compartment 1 and the fermentation and ensilage compartment 3. Evaporator EVA is mounted below the bottom 9 of the freezing compartment 1. Two return ducts P1 and P2 are formed between the top 12 of the fermentation and ensilage compartment 3 and the bottom 11 of the cooling compartment 2. Ducts P1 and P2 terminate at their respective openings OP1 and OP2 formed at the proximity of the front wall of the freezing compartment 2. Each opening is an exit of the two return ducts P1 and P2. Accordingly, air in the fermentation and ensilage compartment 3 and a refrigerating compartment 4 returns to the cooling compartment 2 via the return ducts P1 and P2 and the related openings OP1 and OP2 respectively.

The fermentation and ensilage compartment 3 includes the partition between the cooling compartment 2 and the fermentation and ensilage compartment 3 as being the top 12 and the rear panel 13 which is spaced apart from the rear wall 7 a predetermined distance. Another partition is between the fermentation and ensilage compartment 3 and the refrigerating compartment 4 and forms the bottom 14 of compartment 3. Thus, the fermentation and ensilage compartment 3 is defined by the top 12, the rear panel 13, the bottom 14 and a pair of side walls (not shown). A door 3A hinged to the side wall opens and closes the front face of the fermentation and ensilage compartment 3.

A heater duct assembly 5 is mounted on the top 12 near the door. The heater duct assembly 5 comprises a fan FAN2, a heater HT and a duct containing them. As shown, the duct includes an opening at downward face and another opening at rearward face. The air delivered into the heater duct assembly 5 by the fan FAN2 is heated via heater HT and is vented out the rear opening. The rear panel 13 includes two openings at the upper 13A and the lower 13B position formed therein. The openings are opened and closed by dampers DAMP1 and DAMP2. An open and closed detection apparatus and an open and closed driving apparatus drive the dampers DAMP1 and DAMP2 so that the control portion of the refrigerator controls them.

The lower opening 13B opens into the delivery duct P3 positioned between the rear wall 7 and the rear panel 13. Accordingly, air chilled by the evaporator EVA flows into the fermentation and ensilage compartment 3 through the opening 13B. Also, the upper opening 13A opens into the duct P1 delivering air to the cooling compartment 2. The air of the fermentation and ensilage compartment 3 returns to the cooling compartment 2 through the opening 13A. A temperature sensor TS2 is mounted at a lower portion of the compartment 3 and transmits temperature data to the control portion of the defined refrigerator.

The refrigerating compartment 4 is defined by the top panel 14, the rear wall 7, the bottom 8, two side walls (not shown) and a door 4A. The door 4A, mounted by hinges (not shown), opens and closes the refrigerating compartment 4. The partition between the fermentation and ensilage compartment 3 and the refrigerating compartment 4 is the top panel 14 of the refrigerating compartment 4. An opening 4B is formed on the top panel 14 near the door 4A and opens into the return duct P5 formed in the partition, and subsequently into return duct P2.

A compressor COMP is positioned between the lower portion of the rear wall 7 and the rear face of housing, as shown at FIG. 1. The rear wall of the refrigerating compartment 4 is connected to the rear wall of the refrigerator at a predetermined height above the compressor COMP. An opening 4C leading to the delivery duct P3 is formed in the lower portion of the rear wall 7 and is below the top panel 14. Damper DAMP3 is driven by a damper driving apparatus and a control portion so that it opens and closes the opening 4C. The bottom of the refrigerating compartment 4 is the bottom of the refrigerator. The rear wall 7 is formed near the compressor COMP. Temperature sensor TS3 is mounted at the rear wall and transmits the temperature of the refrigerating compartment 4 to the control portion of the refrigerator.

Figure 2:
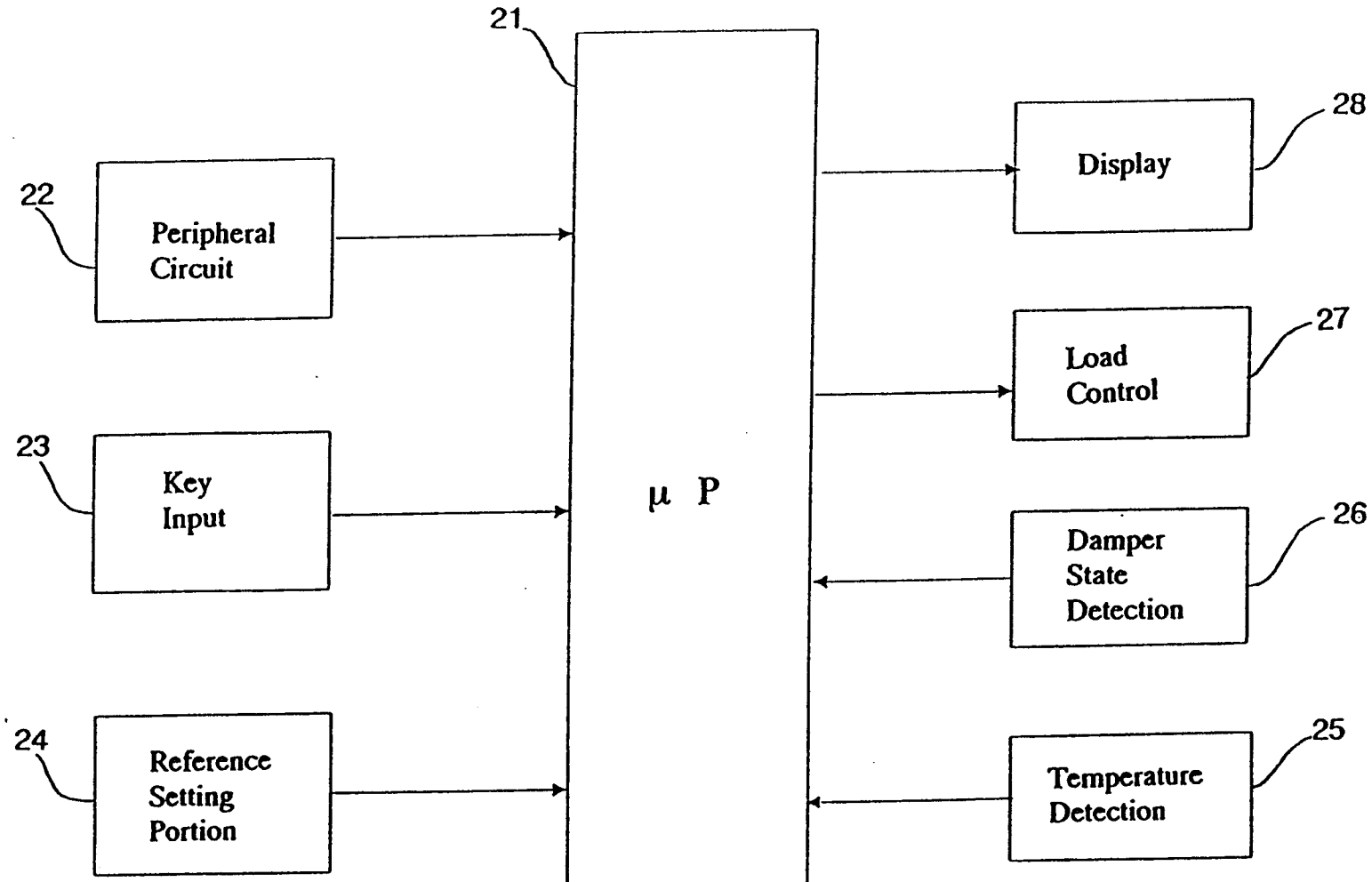
FIG. 2 is a block diagram showing the controlling portion according to the present invention.

FIG. 2 is a block diagram showing the controlling device according to the present invention. As shown, the controlling device comprises microprocessor 21 for controlling the operation of the refrigerator, peripheral circuit portion 22 including voltage regulation circuit, reset circuit and oscillating circuit, key input portion 23 for inputting an operation instruction, including a fermentation/ensilage key and a temperature selection key, reference voltage setting portion 24 for supplying reference voltage to microprocessor 21, temperature detection portion 25 for detecting temperature of each compartment, damper state detection portion 26 for detecting the open and closed state of a damper by a damper switch, load control portion 27 for driving the compressor, fan motor, dampers and heater and so on, and display portion 28 for displaying the operation of each portion. The refrigerator according to the present invention is controlled by the controlling device described above.

Figure 3:
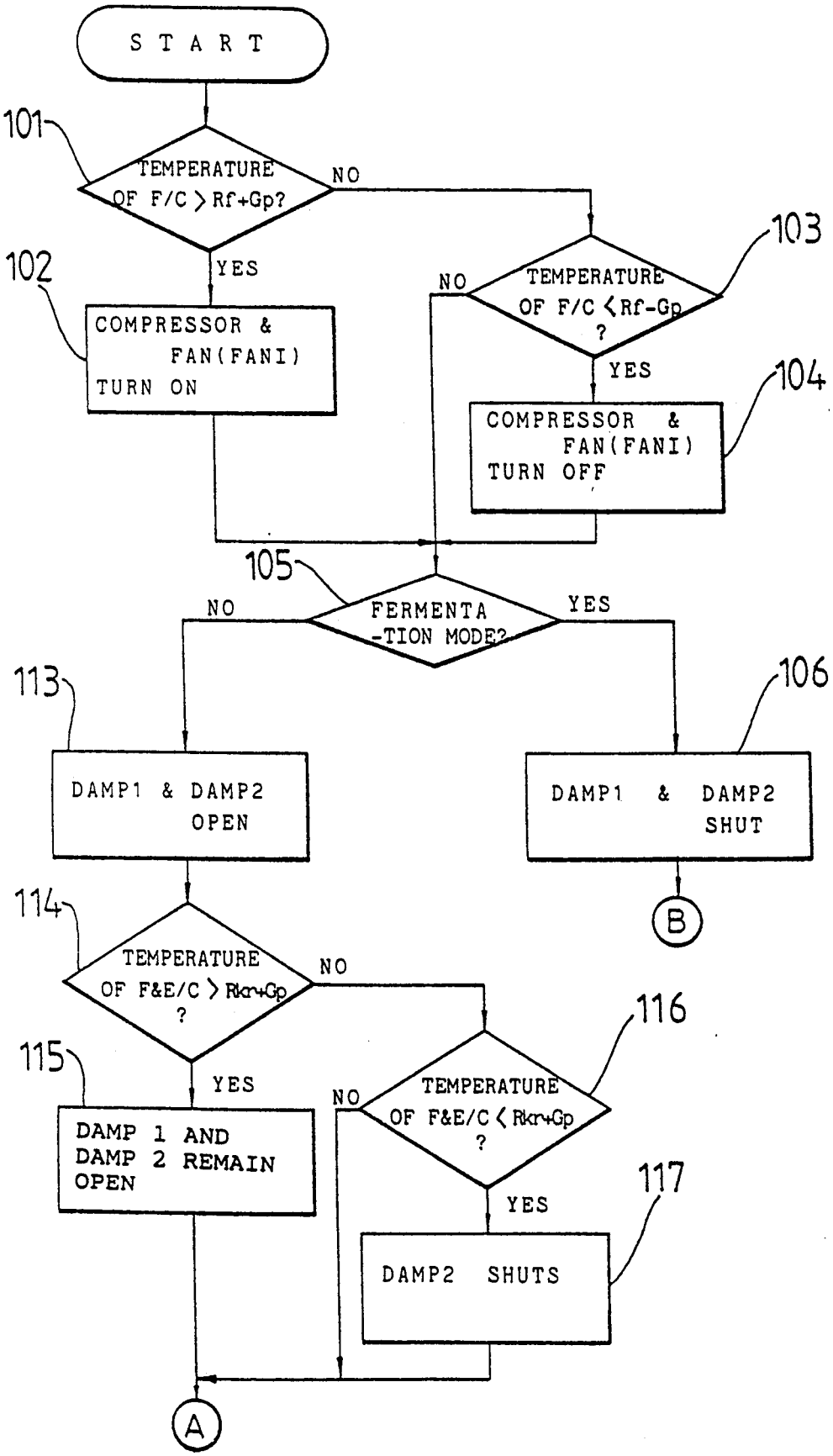
FIGS. 3(A) and (B) are flow charts showing the method of controlling the temperature of the refrigerator according to the present invention.
Figure 3:
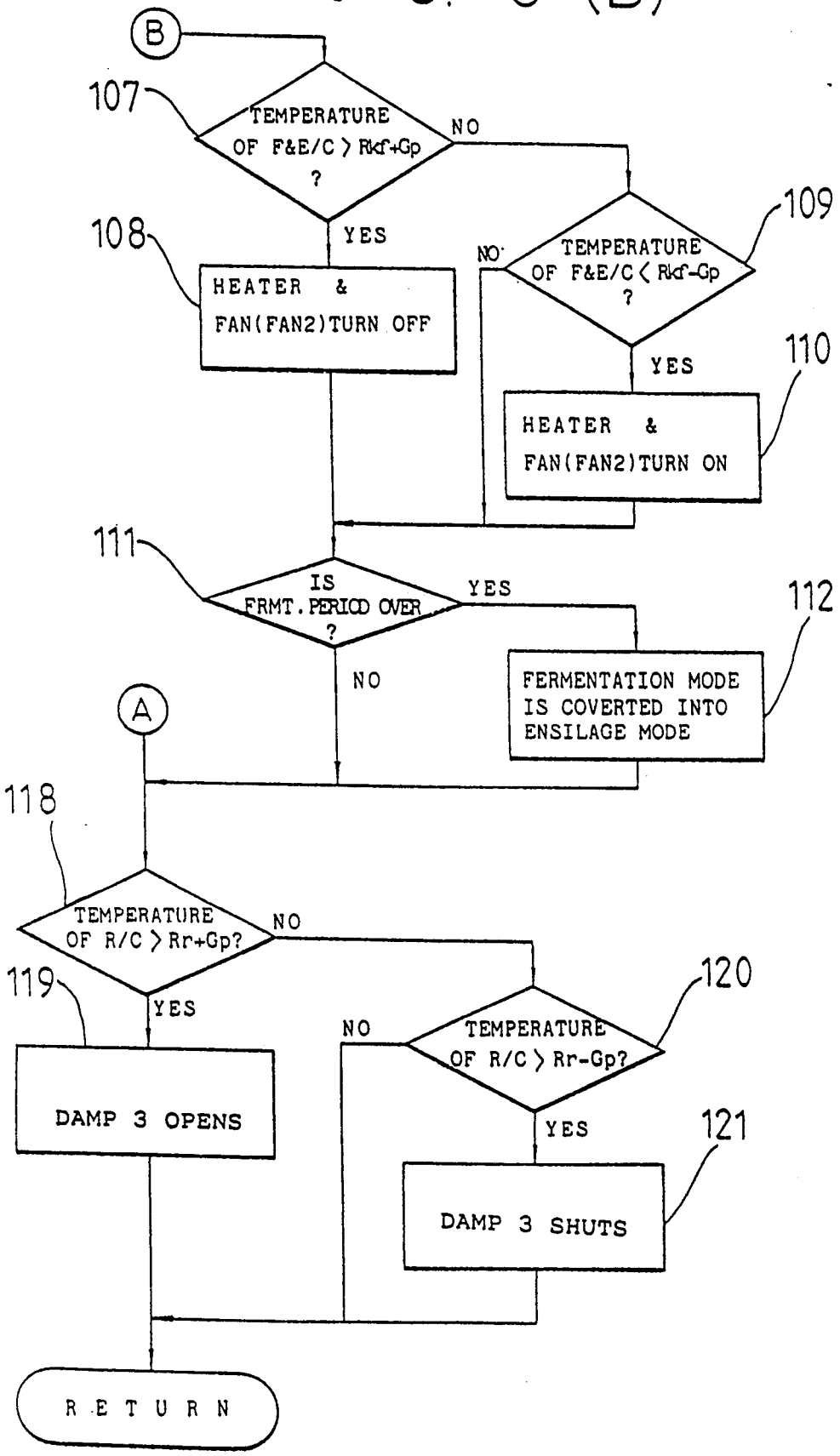

FIGS. 3(A) and (B) are flow charts showing the method of controlling the temperature of the refrigerator according to the present invention.

Microprocessor 21 controls compressor COMP and fan FAN1 based on the temperature of the freezing compartment 1 detected by temperature sensor TS1. In step 101, the temperature of the freezing compartment 1, detected by temperature sensor TS1, is compared with the upper limitation of the freezing temperature (=freezing temperature Rf+tolerance Gp). When the answer is yes, compressor COMP and fan FAN1 turn on (step 102). At this time, the air chilled in the cooling compartment 2 is delivered to the freezing compartment 1 through delivery duct P4 by fan FAN1.

When the answer is no in step 101, it is inquired whether or not the temperature is lower than the lower limitation of the freezing temperature (=freezing temperature Rf−tolerance Gp) (step 103). When the answer is no, controlling the fermentation and ensilage compartment 3 is performed. When the answer is yes, controlling the fermentation and ensilage compartment 3 is performed after compressor COMP and fan FAN1 are turned off.

Control of the fermentation and ensilage compartment 3 is performed as follow:

In step 105, it is determined whether the key selected in the key input portion 23 is the fermentation key. When the fermentation key is not selected, dampers DAMP1 and DAMP2 are open, so the air in the fermentation and ensilage compartment 3 returns to the cooling compartment 2 (step 113). Air chilled by evaporator EVA is delivered through the delivery duct P3 by fan FAN1 and discharged into the fermentation and ensilage compartment 3.

In step 114, it is inquired whether temperature in the fermentation and ensilage compartment 3 is greater than the upper limitation of the ensilage temperature (=ensilage temperature Rkr+tolerance Gp). When the answer is yes, dampers DAMP1 and DAMP2 remain open continuously so that air in fermentation and ensilage compartment circulates via the cooling compartment 2, and the step controlling the refrigerating compartment 4 is successively performed (step 115). When the answer is no in step 114, it is inquired whether temperature in the fermentation and ensilage compartment 3 is lower than the lower limitation of the ensilage temperature (ensilage temperature Rkr−tolerance Gp) (step 116). When the answer is yes in step 116, the delivery damper DAMP2 closes so that the chilled air is cut off and the step controlling temperature of the refrigerating compartment 4 is successively performed (step 117). When the answer is no in the step 116, step controlling temperature of the refrigerating compartment 4 is successively performed.

When the fermentation mode is selected in step 105, a control signal is transmitted to the damper driving apparatus of the load control portion 27 so that the dampers DAMP1 and DAMP2 close and the chilled air may not be discharged into the fermentation and ensilage compartment 3 (step 106). The temperature of the fermentation and ensilage compartment 3 is detected, and it is inquired whether it is greater than the upper limitation of the fermentation temperature (=fermentation temperature Rkf+tolerance Gp) (step 107). When the answer is no, it is inquired whether it is lower than the power limitation of the fermentation temperature (=fermentation temperature Rkf−tolerance Gp) (step 109). When the answer is yes in step 107, heater HT and fan FAN2 are turned off and a next step (step 111) is performed.

When the answer is yes in step 109, heater HT and fan FAN2 are turned on (step 110). At this time, the air in the fermentation and ensilage compartment 3 is delivered into the heater duct assembly 5 via the lower opening to be heated by heater HT. The hot air is discharged into the fermentation and ensilage compartment 3 through the opening formed on the rear face of the heater duct assembly 5. After control of fermentation temperature as above described, it is inquired whether the fermentation period is over (step 111). When the answer is no, the step controlling the refrigerating compartment 4 is continuously performed. When the answer is yes, the fermentation mode of the fermentation and ensilage compartment 3 is converted into the ensilage mode (step 112) and the step controlling the refrigerating compartment 4 is performed. Here, when the temperature of the fermentation and ensilage compartment 3 is greater than the desired ensilage temperature, dampers DAMP1 and DAMP2 open so that the chilled air can circulate from the cooling compartment 2 to the fermentation and ensilage compartment 3. When lower, they close so that the chilled air does not circulate therein.

In step 118, the temperature of the refrigerating compartment 4 is detected by temperature sensor TS3 of the temperature detection portion 25, and it is inquired whether it is larger than the upper limitation of the refrigerating temperature(=refrigerating temperature Rr+tolerance Gp). When the answer is yes, the delivery damper DAMP3 opens so that the chilled air is delivered into the refrigerating compartment 4 (step 119) and the process returns to the main routine. As described above, chilled air takes heat from refrigerating food. Warmed air flows into the return duct P5 via the opening 4B formed on the top panel 14 and returns to the cooling compartment 2 by the return duct P2. Air is delivered in the delivery ducts P3 and P4 by fan FAN1 after it has been chilled by the evaporator EVA. It is discharged into the refrigerating compartment 4 via the opening 4C formed on the rear wall 7.

When the answer is no in step 118, it is inquired whether the temperature of the refrigerating compartment 4 is lower than the lower limitation of the refrigerating temperature(=refrigerating temperature Rr−tolerance Gp)(step 120). When the answer is no, the process returns directly to the main routine. When the answer is yes, damper DAMP3 shuts so that the chilled air does not flow into the refrigerating compartment 4 (step 121), and the process returns to the main routine.

As described above, the refrigerator according to the invention, includes a fermentation and ensilage compartment independent from a freezing compartment and a refrigerating compartment, and can perform a fermentation function and perform ensilage function thereafter. Accordingly, because consumers need not purchase a refrigerator for fermentation, they not only cut expenses but save floor space.

What is claimed is:

1. A refrigerator for preserving food, said apparatus comprising:

a freezing compartment providing a freezing temperature sufficient to preserve food by freezing the food;

a refrigerating compartment providing a refrigerating temperature sufficient to preserve food by cooling the food;

a fermentation and ensilage compartment providing a temperature range extending from a refrigerating temperature sufficient to preserve food by cooling to a temperature sufficient to promote fermentation of food to preserve the food;

means for chilling air;

means for delivering said chilled air to said freezing compartment, said refrigerating compartment and said fermentation and ensilage compartment;

first air discharging means for discharging air from said fermentation and ensilage compartment and toward said means for chilling air;

second air discharging means for discharging air from said refrigerating compartment and toward said means for chilling air;

means for heating said fermentation and ensilage compartment; and means for controlling said temperature within said freezing compartment, said refrigerating compartment and said fermentation and ensilage compartment, and for controlling air flow into and from said fermentation and ensilage compartment via said first air discharging means and said means for delivering said chilled air independently in dependence upon temperature within said fermentation and ensilage compartment.

2. A refrigerator as claimed in claim 1, wherein said controlling means comprises:

during a fermentation mode stopping delivery of said chilled air by said delivering means and said first air discharging means and activating said heating means to discharge heat into said fermentation and ensilage compartment to maintain the temperature of the fermentation and ensilage compartment is held at the fermentation temperature.

during an ensilage mode stopping said discharge of heat by said heating means and the enabling said delivery of chilled air by said delivering means and the first air discharging means to maintain the temperature of the fermentation and ensilage compartment at the ensilage temperature.

3. A method of controlling a refrigerator comprising a freezing compartment, a refrigerating compartment and a fermentation and ensilage compartment, comprising the steps of:

detecting a temperature of the freezing compartment and holding the temperature of the freezing compartment at a freezing reference temperature;

holding a temperature of the fermentation and ensilage compartment at a fermentation temperature in response to the selection of a fermentation mode after holding the temperature of the freezing compartment at said freezing reference temperature;

converting the fermentation mode into an ensilage mode, automatically, upon completion of fermentation by said step of holding the temperature of the fermentation and ensilage compartment at said fermentation temperature;

holding the temperature of the fermentation and ensilage compartment at an ensilage temperature in response to the conversion to said ensilage mode after maintaining said temperature of the fermentation and ensilage compartment at said fermentation temperature; and holding the temperature of the refrigerating compartment at the refrigerating reference temperature in response to the completion of the ensilage mode after said step of holding the fermentation and ensilage compartment at said ensilage temperature.

4. In a refrigerator comprising a freezing compartment, a refrigerating compartment, a cooling compartment for chilling air, and a fermentation and ensilage compartment having heating means and providing a temperature range extending from an ensilage temperature to a fermentation temperature, said fermentation and ensilage compartment further comprising:

temperature sensing means for detecting the temperature in said fermentation and ensilage compartment;

a fan disposed to maintain said temperature in said fermentation and ensilage compartment uniformly;

air inflow means for delivering chilled air from said cooling compartment to said fermentation and ensilage compartment; and air discharging means for discharging room air out of said fermentation and ensilage compartment and toward said cooling compartment;

first damping means for preventing passage of room air from said fermentation and ensilage compartment into said air discharging means; and second damping means for preventing passage of chilled air from said air inflow means into said fermentation and ensilage compartment;

said heating means and said fan being driven with said first and second damping means being closed, when said fermentation temperature is below a lower fermentation reference temperature;

said heating means and said fan being not driven when said fermentation temperature is above an upper fermentation reference temperature.

5. A refrigerator as claimed in claim 4, wherein said fermentation and ensilage compartment comprises a partition disposed to separate said fermentation and ensilage compartment from said cooling compartment, said partition being formed by extending a panel from top to rear of said fermentation and ensilage compartment and spaced apart from a rear wall of the refrigerator.

6. A method of controlling a refrigerator comprising a freezing compartment, a refrigerating compartment, a cooling compartment for chilling air, and a fermentation and ensilage compartment having heating means and providing a temperature range extending from an ensilage temperature to a fermentation temperature, comprising the steps of:

performing a step of controlling the freezing compartment by detecting current temperature of the freezing compartment and holding said current temperature at a freezing reference temperature;

performing a fermentation step by holding a temperature of the fermentation and ensilage compartment at a fermentation mode temperature in response to selection of a fermentation mode after said step of controlling the freezing compartment;

converting the fermentation mode into an ensilage mode, automatically, upon completion of said fermentation step;

holding the temperature of the fermentation and ensilage compartment at an ensilage mode temperature in response to selection of the ensilage mode after said step of controlling the freezing compartment; and holding the temperature of the refrigerating compartment at a refrigerating reference temperature in response to the selection of the ensilage mode after controlling the fermentation and ensilage compartment.

7. A refrigerator-heater apparatus as claimed in claim 1, further comprised of said fermentation and ensilage compartment comprising:

first damping means controlled by said controlling means for preventing air from being discharged via said first air discharging means from said fermentation and ensilage compartment; and second damping means controlled by said controlling means for preventing air from being delivered via said delivery means to said fermentation and ensilage compartment.

8. A refrigerator-heater apparatus as claimed in claim 7, wherein said refrigerating compartment comprises:

third damping means controlled by said controlling means for preventing air from being delivered via said delivery means to said refrigerating compartment; and opening means for allowing air to be discharged from said refrigerating compartment to said second air discharging means.

9. A refrigerator-heater apparatus as claimed in claim 7, further comprised of said heating means comprising:

a heater;

a fan oriented to blow air across said heater; and heater duct receiving air from said fermentation and ensilage compartment and emitting air heated by said heater into said fermentation and ensilage compartment.

10. A refrigerator-heater apparatus as claimed in claim 9, further comprised of said first and second damping means, said heating means and said fan being operated by said controlling means in dependence upon a temperature of said fermentation and ensilage compartment during a fermentation mode.

11. A refrigerator-heater apparatus as claimed in 9, further comprised of said controlling means comprising:

processing means for receiving a plurality of inputs and transmitting a plurality of outputs in response to said inputs;

key input means for receiving operation mode instructions from a user;

reference voltage setting means for providing a reference voltage to said processing means;

temperature detection means for determining a temperature in each of said freezing, refrigerating and fermentation and ensilage compartments;

damper state detection means for detecting open and closed states of said first and second damping means;

load control means for driving said means for chilling air, said heating means and said first and second damping means.

12. The method of controlling a refrigerator as claimed in claim 3, further comprising the step of:

holding the temperature of the refrigerating compartment at the refrigerating reference temperature after holding the temperature of the fermentation and ensilage compartment at said fermentation temperature if said fermentation period is not completed; and converting into said ensilage mode when said fermentation period is completed.

13. The method of controlling a refrigerator as claimed in claim 3, further comprising:

said step of detecting and holding the temperature of the freezing compartment at a comprising:

making a first comparison of the temperature of the freezing compartment to an upper and a lower freezing limit;

turning a compressor and a fan on and off in dependence upon said first comparison;

said step of holding the temperature of the fermentation and ensilage compartment at an the fermentation temperature comprising:

shutting a delivery damper and a discharge damper of said fermentation and ensilage compartment;

making a second comparison of the temperature of the fermentation and ensilage compartment to an upper and a lower fermentation limit;

turning a heater and a heater fan on and off in dependence upon said second comparison;

said step of holding the temperature of the fermentation and ensilage compartment at the ensilage temperature comprising:

making a third comparison of the temperature of the fermentation and ensilage compartment to an upper and a lower ensilage limit;

opening and closing the delivery damper and discharge damper in dependence upon said third comparison;

said step of holding the temperature of the refrigerating compartment at the refrigerating compartment reference temperature comprising:

making a fourth comparison of the temperature of the refrigerating compartment to an upper and a lower refrigerating limit; and opening and closing a refrigerating damper in dependence upon said fourth comparison.

14. The refrigerator as claimed in claim 4, further comprised of means for:

closing said first and second damping means when said ensilage temperature is below a lower ensilage reference temperature; and opening said first and second damping means when said ensilage temperature is above an upper ensilage reference temperature.

15. The refrigerator-heater apparatus as claimed in claim 1, further comprised of said second air discharging means comprising:

a first duct allowing passage of air from said refrigerating compartment; and a second duct passing through said fermentation and ensilage compartment, receiving air from said first duct and discharging air from said first duct to said means for chilling air.

16. The refrigerator of claim 1, further comprised of said controlling means:

detecting a temperature of the freezing compartment and holding the temperature of the freezing compartment and holding the temperature of the freezing compartment at a freezing reference temperatures;

holding a temperature of the fermentation and ensilage compartment at a fermentation temperature in response to the selection of a fermentation mode after said holding of the temperature of the freezing compartment at said freezing reference temperature;

converting the fermentation mode into an ensilage mode, automatically, upon completion of fermentation by said step of holding the temperature of said fermentation and ensilage compartment at said fermentation temperature;

holding the temperature of the fermentation and ensilage compartment at an ensilage temperature in response to the conversion of said ensilage mode after said step of maintaining said temperature of the fermentation and ensilage compartment at said fermentation temperature; and holding the temperature of the refrigerating compartment at the refrigerating reference temperature in response to the completion of the ensilage mode after said step of holding the fermentation and ensilage compartment at said ensilage temperature.

17. The refrigerator of claim 16, further comprised of said controlling means:

holding the temperature of the refrigerating compartment at the refrigerating reference temperature after holding the temperature of the fermentation and ensilage compartment at said fermentation temperature if said fermentation period is not completed; and converting in two said ensilage mode when sid fermentation is completed.

18. The refrigerator-heater apparatus as claimed in claim 11, further comprised of said controlling means further comprising:

display means for displaying a condition of each of said processing means, key input means, reference voltage setting means, temperature detection means, damper state detection means and load control means.

* * * * *